US006561406B1

(12) United States Patent
Furutsu et al.

(10) Patent No.: US 6,561,406 B1
(45) Date of Patent: May 13, 2003

(54) LOCK MEMBER ATTACHMENT DEVICE AND LOCK MEMBER USED THEREFOR

(75) Inventors: Akira Furutsu, 2-20-12-704 Ryougoku Sumida-ku, Tokyo (JP); Syouichi Fukami, Tokyo (JP)

(73) Assignees: Akira Furutsu, Tokyo (JP); Syouchi Fukami, Tokyo (JP); Kabushiki-Kaisya Toska, Tokyo (JP)

( * ) Notice: Subject to any disclaimer, the term of this patent is extended or adjusted under 35 U.S.C. 154(b) by 0 days.

(21) Appl. No.: 09/876,682

(22) Filed: Jun. 7, 2001

(30) Foreign Application Priority Data

Jun. 13, 2000 (JP) ..... 2000-176578
Mar. 9, 2001 (JP) ..... 2001-066243

(51) Int. Cl.[7] ..... B25C 1/04

(52) U.S. Cl. ..... 227/67; 227/71; 227/124; 227/134

(58) Field of Search ..... 227/67, 71, 124, 227/134, 132

(56) References Cited

U.S. PATENT DOCUMENTS 1,983,397 A * 12/1934 Polzer ..... 227/124
2,574,988 A * 11/1951 Vogel ..... 227/134
2,707,783 A * 5/1955 Sullivan ..... 227/71
3,172,122 A * 3/1965 Clay ..... 227/124
3,735,908 A * 5/1973 Kinney et al. ..... 227/124
4,533,076 A * 8/1985 Bourque ..... 227/71
5,364,000 A * 11/1994 Fealey ..... 227/134

* cited by examiner

*Primary Examiner*—Scott A. Smith
(74) *Attorney, Agent, or Firm*—Frishauf, Holtz, Goodman & Chick, P.C.

(57) ABSTRACT

A lock member attachment device comprising a main body containing a continuous assembly of lock members each having a filament, the filament being provided on each end thereof with a coming-off preventive portion, the main body including elements for pushing the assembly forward and a pair of guide needles disposed at a front portion of the main body, the coming-off preventive portions of the lock member located at a foremost end of the assembly being inserted into the pair of guide needles; an upper lid pivotally supported at a rear end thereof above the main body, the upper lid including a piston member adapted to push out the lock member, which is inserted into the pair of guide needles, forward through a return; and a receiving base pivotally supported at a rear end thereof under the main body and adapted to support an object; the upper lid being provided at a part thereof with a roll or link member for allowing the upper lid and the main body to move in unison at an early stage of movement but releasing the unisonous movement when a lower end of the roll or link member contacts the receiving base.

7 Claims, 4 Drawing Sheets

LOCK MEMBER ATTACHMENT DEVICE AND LOCK MEMBER USED THEREFOR

BACKGROUND OF THE INVENTION

1. Field of the Invention

This invention relates to a lock member attachment device and a lock member used for it, and more particularly to a lock member attachment device and a lock member used for it, which are suited to be used for densely attaching labels to a cloth product.

2. Related Art

In general, for sticking a tag indicating price, quality, etc. to a fabric product such as clothes, a string has been used. Recently, a tag locking tool called "tag pin", which is made of plastics, was used for the same purpose.

However, the conventional manner for sticking a tag to a fabric product using a string or a tag locking tool has such an inconvenience that the tag is swung in a suspended fashion and liable to come off easily. Moreover, because a denim and a jeans as a weaved cotton cloth are dense in mesh, a needle used for attaching a string and a tag pin is difficult to be inserted into such a dense cloth.

For this reason, it is an ordinary practice that a tag is stuck to an object, particularly, a denim and a jeans by a metal needle (staple). However, this metal needle is not suited to be used for a soft cloth. Moreover, this metal needle is not well accepted from a view point of recently prevailing social demands such as prevention of injury and difficulty in disposal after use. Thus, use of other materials than the metal needle are demanded.

In order to meet with this demand, an attachment device and a lock member are developed in which the lock member is formed in an H-shaped configuration and a tag is stuck to an object by a central filament and coming-off preventive portions formed on opposite ends thereof. However, this conventional attachment device is an installed type and complicated in mechanism. And a supporting frame (runner) is indispensable for the lock members in order to keep shape and for reinforcement in an assembled state of the individual lock members.

SUMMARY OF THE INVENTION

The present invention has been accomplished in view of the abovementioned situation and problems inherent in the conventional device. It is, therefore, an object of the present invention to provide, in order to solve the above-mentioned problems, a lock member attachment device which is handy and simple in mechanism and in which any desired material can be used as a raw material. It is also another object of the present invention to provide a lock member in which there is no need of a provision of a supporting frame and the advantage of its raw material can be effectively utilized.

To achieve the above objects, there is essentially provided a lock member attachment device comprising a main body containing a continuous assembly of lock members each having a filament, the filament being provided on each end thereof with a coming-off preventive portion, the main body including means for pushing the assembly forward and a pair of guide needles disposed at a front portion of the main body, the coming-off preventive portions of the lock member located at a foremost end of the assembly being inserted into the pair of guide needles, an upper lid pivotally supported at a rear end thereof above the main body, the upper lid including a piston member adapted to push out the lock member, which is inserted into the pair of guide needles, forward through return means, and a receiving base pivotally supported at a rear end thereof under the main body and adapted to support an object, the upper lid being provided at a part thereof with a roll or link member for allowing the upper lid and the main body to move in unison at an early stage of movement but releasing the unisonous movement when a lower end of the roll or link member contacts the receiving base. The lock member attachment device may further comprises a projecting cover disposed at a front and an upper part of the receiving table and adapted to protect a finger tip and the object from foremost ends of the guide needles and restrain a pulling up motion of the object when the guide needles are returned. Preferably, the piston member is formed in a downwardly facing U-shaped configuration and an upper part of the piston member is supported by a holder such that an angle thereof can be changed. It is also preferred that the holder is formed in an arcuate configuration from where the piston member is hung. The guide needles may be different in length. Preferably, a groove formed in each of the guide needles and adapted to allow the passage of the filament of the lock member is twisted.

From another aspect of the present invention, there is provided a lock member continuous assembly comprising a plurality of runner-less lock members each having a filament and coming-off preventive portions connected to opposite ends of the filament, the lock members being integrally injection molded from a comparatively soft material such as plastics and rubber in such a manner that every adjacent lock members are connected with each other at a spot so that the lock members can easily be separated individually only with a small pressure. Preferably, the filament is in a straight form so that stretching properties of its raw material by pressure can be utilized. It is also accepted that the filament is somewhat loosened. The raw material is preferably a biodegradable material. It is also preferred that the raw material can be torn off by finger tips.

From a further aspect of the present invention, there is provided a lock member attachment device comprising a base plate having a flange at a lower edge thereof, a movable plate pivotally supported on the base plate and integrally provided with a lever portion, a part of the movable plate being tensile biased by biasing means disposed between the base plate and the movable plate, a receiving member supported on a front lower part of the base plate such that a part thereof is faced with the base plate, a lever member operatively connected to the movable plate and pivotally supported at a lower end thereof, a link member whose rear end is pin-connected to a front end of the link member through an elongated hole, a piston member being moved up and down by a front end of the link member, a pair of hollow needles for allowing the piston member to be inserted therein, and a lock member feed mechanism pivotally supported and operated by the front end of the link member. Preferably, a lock member carrier path formed in the base plate and extending to the hollow needles is formed with a guide flange on which a lock member pushing and feeding piece is disposed. It is also preferred that a space for allowing the object to be pushed therein is formed the lower edge of the base plate and an upper surface of the receiving member, and a stopper member to be abutted with a front end of the inserted object is positionally displaceably disposed in a part of the space. It is preferred that the base plate is provided at a lower end thereof with an auxiliary member for withdrawing the pair of hollow needles from the object, the auxiliary member being provided with a window opening for allowing the needles to be inserted therein.

Preferably, a curved surface portion formed on the front end of the lever portion is engaged with a protruded/bent piece formed on the receiving member, and the receiving member is raised by the lever portion so that the object is sandwiched and pressurized between the receiving member and the lower edge of the base plate. The lock member attachment device may further comprise a claw member disposed at a terminal end of the lock member carrier path near the hollow needles, the claw member being biased by a spring member for preventing the lock member from returning. It is preferred that the lock member feed mechanism pivotally moves a pivotally supported exterior body having a lateral U-shaped configuration in section by slidingly pressing a curved plate spring fitted to the exterior body with a tip portion of the link member when the link member is returned, so that a feed claw formed on a lower end of the exterior body feeds the lock member by a predetermined pitch.

DETAILED DESCRIPTION OF THE PREFERRED EMBODIMENTS

Figure 1:
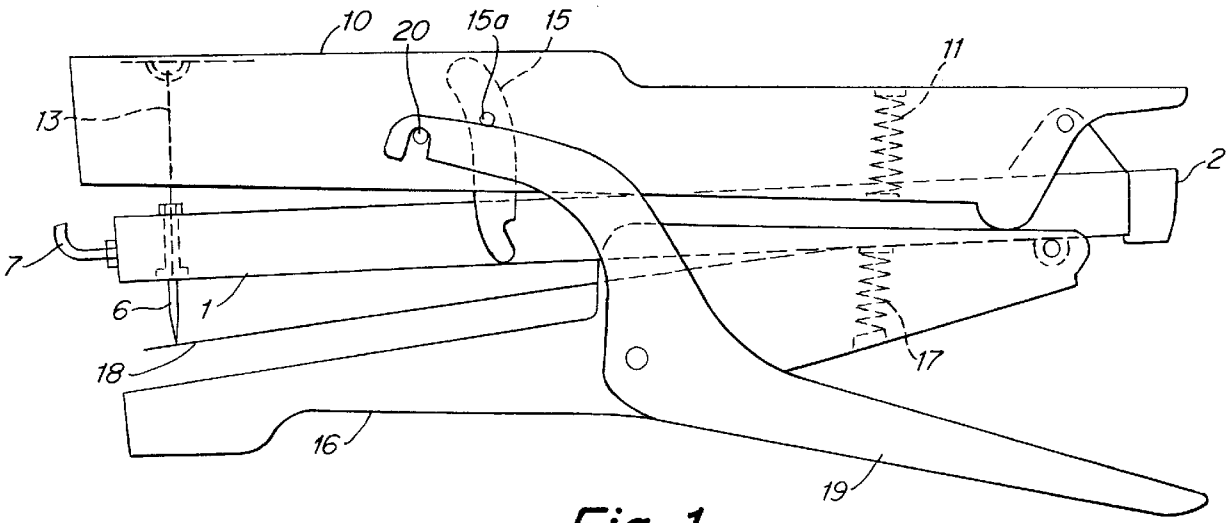
FIG. 1 is a side view showing a lock member attachment device incorporated with the present invention.
Figure 2:
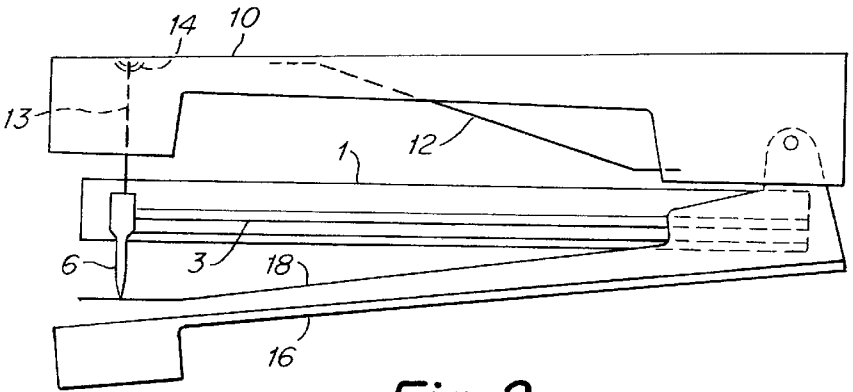
FIG. 2 is a side view showing another example.
Figure 3:
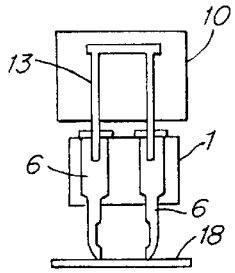
FIG. 3 is a front view thereof.
Figure 4:
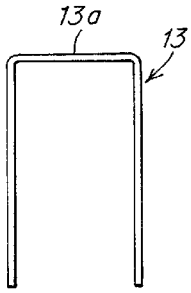
FIG. 4 is a front view of a piston member.
Figure 5:
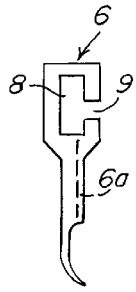
FIG. 5 is a front view showing a guide needle.
Figure 6:
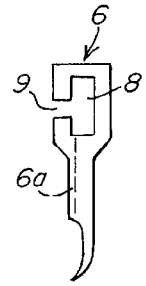
FIG. 6 is a rear view thereof.
Figure 7:
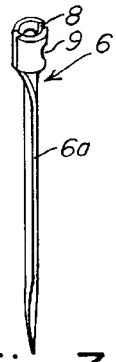
FIG. 7 is a perspective view showing a second example of the guide needle.
Figure 8:
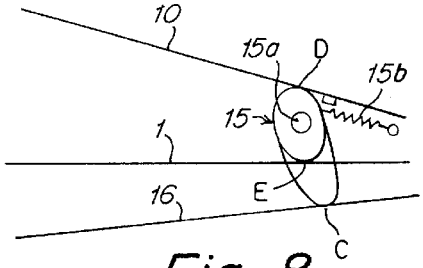
FIG. 8 is an explanatory view showing the function of a roll member
Figure 9:
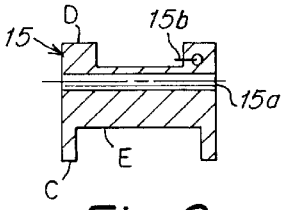
FIG. 9 is a sectional view showing the roll member.
Figure 10:
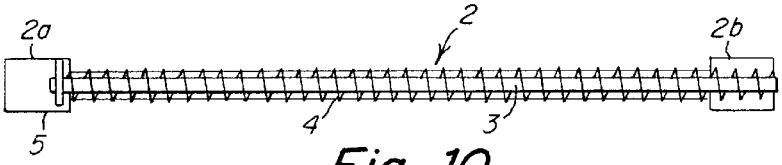
FIG. 10 is a side view showing a pressing mechanism of a lock member assembly.
Figure 11:
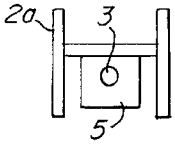
FIG. 11 is a front view thereof.
Figure 12:
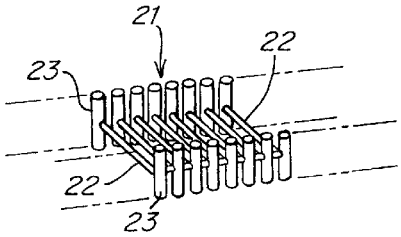
FIG. 12 is a perspective view showing the assembly of the lock members.
Figure 13:
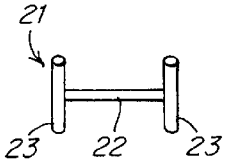
FIG. 13 is a perspective view showing a first example of the lock member.
Figure 14:
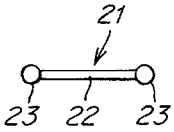
FIG. 14 is a plan view thereof.
Figure 15:
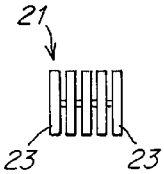
FIG. 15 is a side view showing a continuous state.
Figure 16:
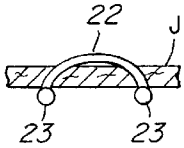
FIG. 16 is a sectional view showing a state of use.
Figure 17:
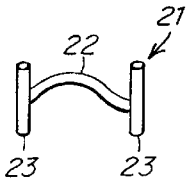
FIG. 17 is a perspective view showing a second example of the lock member.
Figure 18:
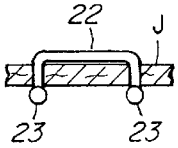
FIG. 18 is a sectional view showing a state of use thereof.
Figures 19, 20, 21, 22:
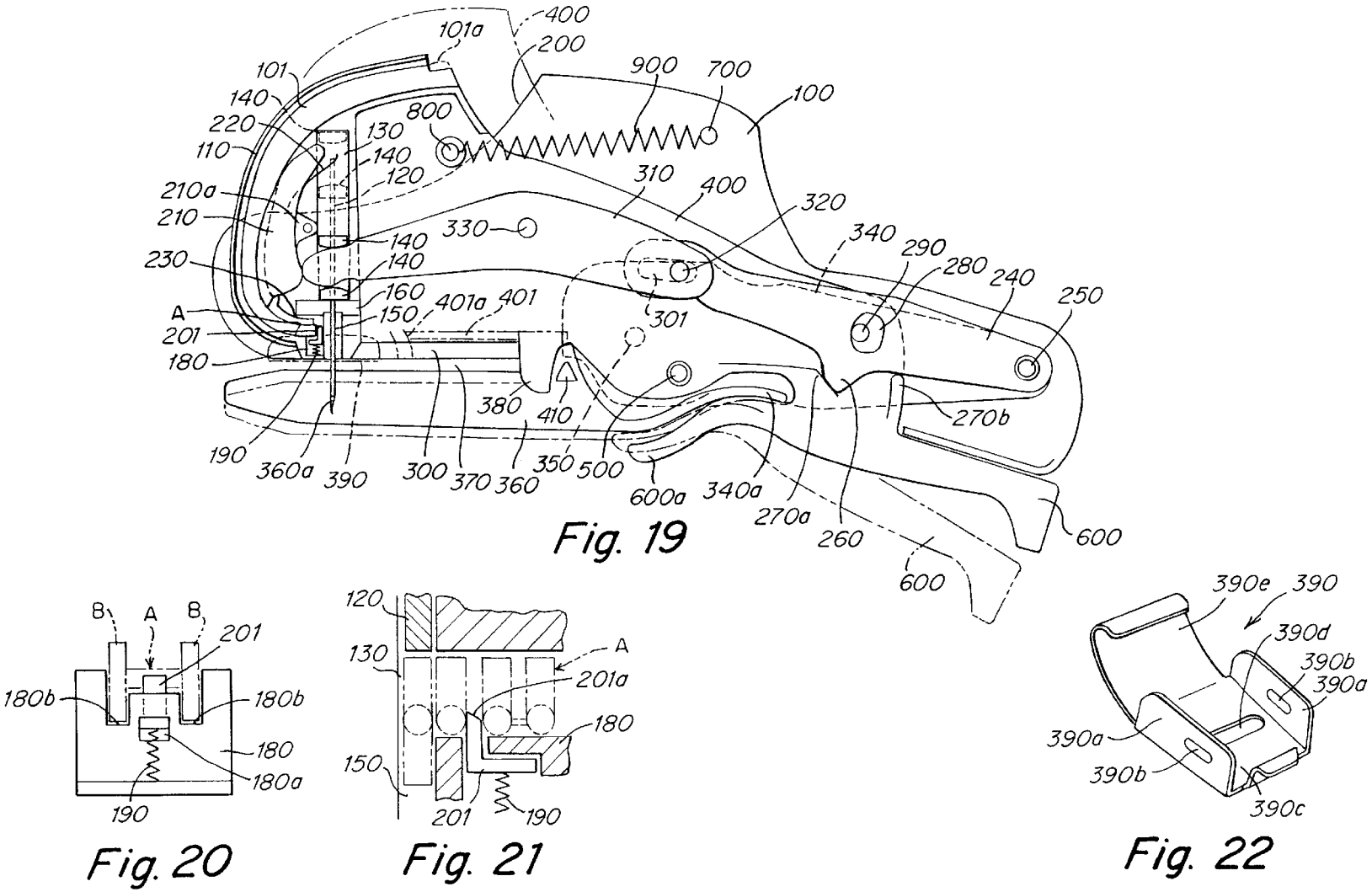
FIG. 19 is a view showing a mechanism of an attachment device of a lock member incorporated with the present invention
FIG. 20 is a front view showing a claw member mechanism adapted to prevent return.
FIG. 21 is a side view thereof.
FIG. 22 is a perspective view showing an auxiliary member for withdrawing a hollow needle.
Figure 23:
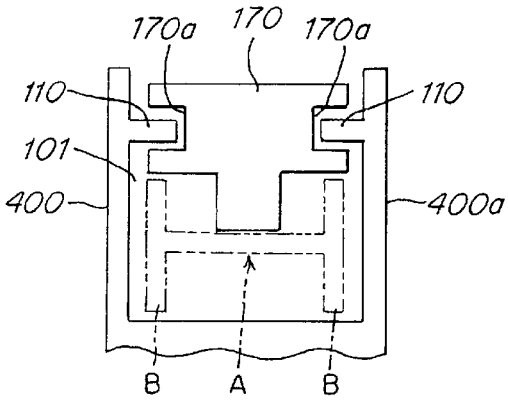
FIG. 23 is a front view showing a mounting state of a press feeding piece of the lock member.
Figure 24:
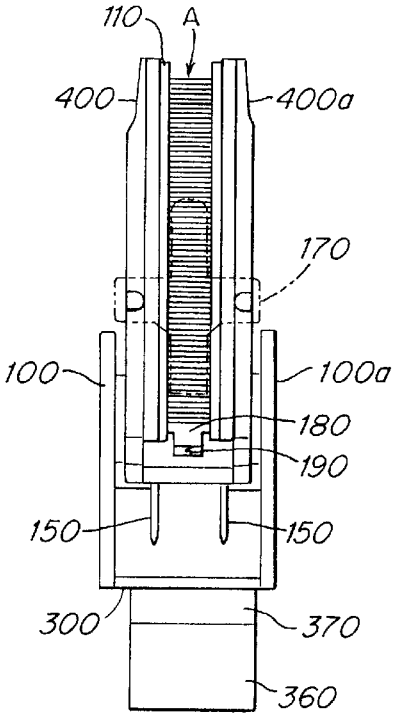
FIG. 24 a front view of the attachment device in which a continuous assembly of the lock members is loaded.
Figure 25:
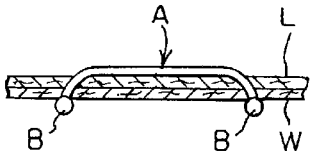
FIG. 25 is a view showing a state of use of the lock member.

Some preferred embodiments of the present invention will now be described with reference to the accompanying drawings, in which FIG. 1 is a side view showing a lock member attachment device incorporated with the present invention, FIG. 2 is a side view showing another example, FIG. 3 is a front view thereof, FIG. 4 is a front view of a piston member, FIG. 5 is a front view showing a guide needle, FIG. 6 is a rear view thereof, FIG. 7 is a perspective view showing a second example of the guide needle, FIG. 8 is an explanatory view showing the function of a roll member, FIG. 9 is a sectional view showing the roll member, FIG. 10 is a side view showing a pressing mechanism of a lock member assembly, FIG. 11 is a front view thereof, FIG. 12 is a perspective view showing the assembly of the lock members, FIG. 13 is a perspective view showing a first example of the lock member, FIG. 14 is a plan view thereof, FIG. 15 is a side view showing a continuous state, FIG. 16 is a sectional view showing a state of use, FIG. 17 is a perspective view showing a second example of the lock member, FIG. 18 is a sectional view showing a state of use thereof, FIG. 19 is a view showing a mechanism of an attachment device of a lock member incorporated with the present invention, FIG. 20 is a front view showing a claw member mechanism adapted to prevent return, FIG. 21 is a side view thereof, FIG. 22 is a perspective view showing an auxiliary member for withdrawing a hollow needle, FIG. 23 is a front view showing a mounting state of a press feeding piece of the lock member, FIG. 24 a front view of the attachment device in which a continuous assembly of the lock members is loaded, and FIG. 25 is a view showing a state of use of the lock member.

In those Figures, reference numeral 1 denotes a main body. This main body 1 is in the form of a box case having a U-shaped configuration in section whose upper surface is open. In other words, the main body 1 has an open top. A continuous assembly of lock members (hereinafter referred to as the "lock member continuous assembly" or "assembly" where appropriate) as later described is received in the U-shaped main body 1. The lock member continuous assembly thus received in the main body 1 is normally biased forward of the main body 1 by a press means 2 which is set to the main body 1 from a rear end thereof. A shaft 3 is disposed, in a suspending fashion, between a front end portion 2*a* and a rear end portion 2*b* of the press means 2. A coiled spring 4 is wound around the shaft 3 such that a rear end of the coiled spring 4 is fixed to the rear end portion 2*b*. A pressing plate 5 is fixed to a front end of the coiled spring 4. This pressing plate 5 has a through-hole through which the shaft 3 extends. The pressing plate 5 is abutted with a rear end face of the lock member continuous assembly and caused to push the continuous assembly forward under the effect of the coiled spring 4.

One pair of guide needles 6 are exchangeably and removably disposed in parallel relation at a front portion of the main body 1. This guide needle pair 6 is attached to the main body 1 by fixedly pressing the pair to main body 1 from its front side using a rotary screw type fastening tool 7.

Lower ends of the guide needles 6 are bent inward. Each guide needle 6 has a hollow interior and it has a guide groove 6*a* formed in an inner side thereof. This guide groove is adapted to guide the downward movement of a filament of a lock member as later described. Head portions of the guide needles 6 have a window portion 8 each. This window portion 8 allows a coming-off preventive portion, which is formed on each end of the filament, to be fitted therein. At an inner side of the window portion 8, a slit 9 for allowing the passage of the filament is formed.

The guide needles 6 forming one pair may be different in length. By forming the guide needles 6 different in length, they can more easily be inserted into a hard and dense object such as denim and jeans. The reason is as follows. By inserting the longer guide needle 6 first, force can be concentrated and more smooth and easy insertion can be obtained with less load than in the case where two guide needles are inserted simultaneously.

It is also accepted that the guide groove 6*a* in each guide needle 6 is twisted about 90 degrees. By doing so, when the coming-off preventive portion of the lock member passes through the hollow interior of the guide needle, the filament is deformed in such a manner as to be slightly swollen along the twist of the guide groove 6*a*. This makes it possible that when the coming-off preventive portion passes through the object, resistance generated by the thickness of the object can be absorbed.

On the other hand, reference numeral 10 denotes an upper lid disposed at an upper part of the main body 1 and pivotally supported at a rear end thereof. The lid 10 is provided with a return means such as a coiled spring 11 or a plate spring 12 capable of returning the upper lid 10 to its original position after its pivotal movement.

At a front portion of the upper lid 10, there is a provision of a piston member 13. This piston member 13 is adapted to press down the lock member, which is fittingly inserted into the guide needles 6, so as to be moved downward. Since the piston member 13 is formed in a downwardly facing U-shaped configuration, a cross bar 13*a* disposed at its upper end is held by a piston holder 14.

The piston holder 14 has an upwardly facing arcuate configuration from where the piston member 13 is swingably hung down. That is to say, when the upper lid 10 is pressed so as to be pivotally moved, an angular displacement formed between the piston member 13 and the needle guides 6 is can be properly adjusted.

A roll member 15 is turnably supported in an eccentric manner by a pin 15*a* at an intermediate location of the upper lid 10. An automatic returning coiled spring 15*b* is attached to the roll member 15. This coiled spring 15*b* is adapted to support the upper lid 10 so that the main body 1 and the upper lid 10 is operatively connected to each other until the guide needles 6 inserted into the object arrive at a receiving base, as later described, during operation.

That is to say, this roll member 15 forms a linear portion between a contact point D of the roll member 15 with respect to the upper lid 10 and a contact point E of the roll member 15 with respect to the main body 1. This linear portion makes it possible that the roll member 15 serves as a spacer and a positional relation between the upper lid 10 and the main body 1 is fixedly established. Only excepting this linear portion, the outer periphery of the roll member 15 consists of an arcuate line. When the upper lid 10 is kept pressed and a lower end C formed by the arcuate line of the roll member 15 is abutted with a receiving base as later described, the roll member 15 begins to make a circular motion along the arcuate line and the fixedly established positional relation between the upper lid 10 and the main body 1 is released. As a result, the upper lid 10 automatically presses down the piston member 13 into the needle guides 6 to lock the lock member to the object. It is accepted that instead of the roll member 15, a link member or the like may be employed.

In the drawings, reference numeral 16 denotes a receiving base pivotally supported at its rear end on the main body 1. Although an automatically returning spring 17 is interposed in the illustrated example, a provision of this spring 17 is not absolutely necessary. This receiving base 16 is adapted to support the object at its lower side when the needle guides 6 are inserted into the object.

Likewise, reference numeral 18 denotes a cover for the guide needles 6. This cover 18 is formed on the receiving base 16 either integrally therewith or separately therefrom. A window opening for allowing the insertion of the guide needles 6 is formed in the cover 18. This window opening is adapted to protect the finger tip and the object from the foremost ends of the guide needles 6. It is preferred that the cover is provided with a spring characteristic. By doing so, the cover can move following the motion of the device and automatically return to the original position. Therefore, the object can be prevented from being lifted upward when the cover is returned to the original position.

Since the lock member attachment device according to this embodiment is constructed in the manner as mentioned above, the entire device can be held in one hand and used as a handy stapler type device by depressing the upper lid 10 with a thumb. It is also an interesting alternative that a lever grip 19 is pivotally supported at an intermediate portion thereof on one side face of the receiving base 16 and a projecting pin 20 is formed on one side face of the upper lid 10 so that a tip of the lever grip 19 is hooked on the pin 20.

The lock member 21 used for the lock member attachment device thus constructed includes a filament 22 each end of which is connected to a generally central area of a coming-off preventive portion 23. Thus, the filament 22 with the coming-off preventive portions 23 integrally connected to opposite ends thereof exhibits an H-shaped configuration. The lock member 21 loaded on the main body 1 is in the form of a continuous assembly of the lock members 12 each having the coming-off preventive portions 23. The coming-off preventive portions 23 connected to the opposite ends of each lock member are spot-welded to the corresponding coming-off preventive portions 23 of the adjacent lock member 21 and integrally formed by injection molding such that they can easily be pushed off by a piston member 13 in the back and forth direction. The coming-off preventive portions 23 may take any suitable form like a circle and a semicircle in addition to a bar.

The lock member 21 is made from such a molding material as plastics, rubber and biodegradable material. Owing to the property of the molding material, the lock member 21 thus obtained is comparatively soft. The degree of softness may be properly selected depending on the configuration of the lock member 21.

In the case where a material having a high degree of softness is employed, the filament 22 is formed into a linear configuration as shown in FIGS. 13 to 16. At the time for attaching the lock member 21 to an object J, it is attached to the object J in the form of an arch utilizing the elongation of its material.

In the case where a material having a semi-hard property, it is also accepted that a loosening is preliminarily formed on the filament 22 by calculating the thickness portion of the object J and the filament 22 becomes linear at the time of attachment. The filament 22 itself is not limited to a single linear configuration but it may also take any other desired configuration.

The filament 22 may be preliminarily subjected to stretching treatment in order to enhance the strength of the filament 22. It is also accepted that the filament 22 is subjected to treatment such that a non-stretched portion remains. By doing so, the filament 22 can be stretched by resistance of the object J.

In the case where the lock member 21 has such a degree of strength that it can be torn off when pulled with finger tips, it can be used for the purpose of preliminary fixture. This means that the lock member 21 can be used for preliminarily fixing a button, for attaching a light-weighted toy, cookies, etc. to a mount, and for sticking a label to a clothes.

In the case where a punch is employed instead of the guide needle, the lock member attachment device according to this embodiment can be used as a handy boring tool. Alternatively, in the case where one each of the guide needle 6 and piston member 13 are employed, the device of this embodiment can be used as a binding tool owing to a provision of the lock member. In the latter case, if only one coming-off preventive portion 23 is connected or locked to an object, the other coming-off preventive portion 23 can be used for suspending a label or a tag.

Reference numeral 100 denotes a base plate. This base plate 100 has an arcuate cutout portion 200 formed in a front and upper part thereof and a flange 300 formed on a lower edge thereof. FIG. 19 shows a mechanism of a lock member attachment device of the present invention. As shown in FIG. 24, in the finished article, the mechanism is concealed from outside with a cover 100*a* forming one pair together with the base plate 100 and a cover 400*a* forming one pair together with a movable plate 400 as later described.

The movable plate 400 is pivotally superimposed upon a generally central area at a lower part of the base plate 100 by a pin 500. A lever portion 600 is integrally formed on a rear and lower part of the movable plate 400. The lever portion 600 projects downward and outward of the base plate 100. The movable plate 400 has a tensile biasing coiled spring 900 which is disposed between a screw 700 attached to an upper part of the base plate 100 and a screw 800 attached to the movable plate 400 at a location near an upper part thereof. The movable plate 400 is normally biased to and held in a standby position as indicated by an imaginary line of FIG. 19 by the coiled spring 900. That is to say, FIG. 19 shows a working state in which the lever portion 600 is held in hand.

A carrier path 101 for the lock member continuous assembly A is formed on a front end side of the movable plate 400 such that the carrier path 101 is curved with its deep end left parallel to the flange 300. A guide flange 110 is formed along the carrier path 101 in order to prevent the assembly A from coming off.

A sliding guide portion 130 for the gate-type piston member 120 is disposed in the vicinity of the carrier path 101 of the movable plate 400 along a vertical (up and down) direction. The piston member 120 is attached to one pair of parallel operating holders 140.

At a lower part of the sliding guide portion 130 provided with the operating holders 140, one pair of hollow needles 150 into which the piston member 120 can be inserted are replaceably removably disposed through an attachment member 160. A receiving groove is formed in an upper part of a front face of each hollow needle 150. This receiving groove is adapted to allow the insertion of coming-off preventive rod B disposed at each of the opposite ends of the assembly A.

Moreover, an inlet portion 101*a* of the assembly A in the carrier path 101 is extensively protruded outward in such a manner as to correspond to the cutout portion 200 of the base plate 100. In addition, this inlet portion 101*a* including the guide flange 110 is cut out in order to facilitate the loading and inserting operation of the assembly A.

After the assembly A is loaded on the carrier path 101, a pushing and feeding piece 170 including grooves 170*a* for sandwichingly holding the guide flanges 110 and having a cross-like configuration as a whole can be manually pushed and inserted into the inlet portion 101*a* until the front end of the assembly A reaches the hollow needles 150. The assembly A can also be withdrawn through the inlet portion 101*a*. In addition, since the pushing and feeding piece 170 is located between the movable plate 400 and the cover 400*a*, it also serves as a spacer for keeping an interval formed by and between the movable plate 400 and the cover 400*a*.

On the other hand, a box 180 is set at a terminal end of the carrier path 101 near the hollow needles 150. A claw 201 for preventing the assembly A, whose one end is biased and protruded upward by a coiled spring 190, from returning is disposed at the box 180. The claw 201 has a taper-cut upper surface and exhibits a generally L-shaped configuration. The other end of the claw 201 is projected from a through-hole 180*a* formed in a front face of the box 180 so that the return-prevented state can be released by properly operating the claw 201 when a jamming state has somehow happened. Owing to this arrangement, two each of the lock members are restrained at a time so that the lock member can also be fed into the hollow needles 150 smoothly. The taper-cut upper surface 201*a* helps to feed the lock members smoothly. Guide grooves 180*b* are formed in the upper surface of the box 180. The guide grooves 180*b* are adapted to allow the passage of the coming-off preventive bars B for the assembly A.

A feed mechanism 210 for the assembly A is disposed between the carrier path 101 for the assembly A and a sliding guide portion 130 of the piston member 120. This feed mechanism 210 includes an exterior body having a lateral U-shaped configuration in section and curved into an arcuate shape as a whole. The feed mechanism 210 is pivotally supported on the exterior body through a flange 210*a* projecting backward of the exterior body.

A curved plate spring 220 is held in the exterior body of the feed mechanism 210. A front end of a link mechanism as later described slidingly contacts the plate spring 220 at the time of returning, thereby pivotally moving the exterior body. A feed claw member 230 prepared as a separate member and capable of coping with an accidental jamming state is attached to a lower end of the feed mechanism 210. By the pivotal movement of the exterior body, the feed mechanism 210 feeds the assembly A a predetermined pitch in the direction of the hollow needles 150.

In the drawing, reference numeral 240 denotes a lever member. This lever member 240 is superimposed upon an outer surface side of turning plate 400. A rear end of the lever member 240 is pivotally supported on a rear end portion of the base plate 100. A generally triangular force point piece 260 at least a front surface of which has a projecting arcuate shape is integrally suspended from a lower edge of a generally central area of the lever member 240.

Vertical wall portions 270*a*, 270*b* formed on an upper part of the lever portion 600 are slidingly abutted with front and rear surfaces of the force point piece 260. That is to say, in the standby state, the vertical portion 270 is contacted with the rear surface of the force point piece 260. By grasping the lever portion 100 in hand, this vertical wall portion 270*b* pushes the force point piece 260 so as to be turned about a pin 250. At the time of turning, the force point piece 260 is contacted at its front surface with the vertical wall portion 270*a* and receives a backward operating force.

A through-hole 280 having a deformed shape is formed in a generally central area of the lever member 240. A pin 290 projecting from the movable plate 400 is loosely fitted to this through-hole 280. Due to stress at the force point piece 260, an inner peripheral surface of the through-hole 280 is slidingly contacted with an outer peripheral surface of the pin 290 and conducts a camming action. By doing so, the front end serving as a point of application of the lever member 240 is more powerfully raised upward. This action causes a time lag in actuating a link member 310 as later described due to the pin 290 loosely fitted in the through-hole 280 and after the hollow needles 150 are inserted into the object, the piston member 120 can be press moved along the inside of the hollow needles 150. Thus, the lever member 240 is returned to the initial state smoothly.

An elongated hole 301 whose forward part is slightly enlarged in diameter is formed in a front end of the lever member 240. A pin 320 disposed at a location near a rear end of a link member 310 having a boomerang-like configuration is hooked in this elongated hole 301. Since the front end of the lever member 240, i.e., the elongated hole 301 portion is raised, the pine 320 is further raised in synchronism but with a small time lag along the elongated hole 301.

The link member 310 is pivotally supported at a generally central area thereof by a pin 330. A forward end of the link member 310 is inserted between operating holders 140 of the piston member 120. In accordance with the movement of this link member 310, not only the operating holders 140, 140 but also the piston member 120 are slidingly moved. A projecting end of the link member 310 inserted between the operating holders 140 and projected further slides the plate spring 220 upward at the time of returning, thereby actuating the feed mechanism 210.

In the illustration, reference numeral 340 denotes a receiving member. This receiving member 340 is superimposed at a rear half portion thereof upon a back side of the movable plate 400 and its rear end is supported on the base plate 100 through the pin 250 which pivotally supports the lever member 240. Moreover, at the back surface of the movable plate 400, the receiving member 340 is supported on the base plate 100 through the pin 350.

A front end of this receiving member 340 serves as a receiving portion 360 for the object projected forward along a lower edge of the base plate 100. A gap 370 in which the object is held is formed between the receiving portion 360 and the lower edge of the base plate 100. Reference numeral 380 denotes an inserting stopper of the object which is positioned with respect to the flange 300 and an attaching position of which is variable. This inserting stopper 380 is formed in a generally lateral U-shaped configuration. The stopper 380 is inserted into the gap 370 from the front side along a groove 401 which is formed along the flange 300 and turned along a turning guide 410 formed at a rear part of the receiving portion 360 so as to be set. For removal, the stopper 380 is slidingly moved forward along the groove 401 and twisted along a side taper 401*a* disposed at a front part of the groove 401. By doing so, the stopper 380 can easily be removed.

In the illustration, reference numeral 390 denotes a withdrawing and returning auxiliary member of the hollow needles 150 whose lower surface is located in the gap 370. This auxiliary member 390 is formed from a thin plate. For the attachment of the auxiliary member 390, recesses 390*b* formed in the vertical pieces 390*a* are hooked on a boss disposed at the flange 300. At a front part, an extending piece 390*e* having a curved part along the movable plate 400 is disposed. It is located between the movable plate 400 and the cover 400*a* and serves as a spacer. A forward end and a rear end of the extension piece 390*e* are curved generally in parallel relation and reinforced.

A window opening 390*d* into which the pair of hollow needles 150 are inserted is formed in a bottom plate 390*c* (abutment plate with the object) of the auxiliary member 390. Reference numeral 360*a* denotes a receiving hole formed in the receiving portion 360. This receiving hole 360*a* is adapted to receive the hollow needles 150 pierced through the object. The auxiliary member 390, as well as the stopper 380, etc., can be attached without using a screw or the like and can easily be detached at the time of repairing. In the case where the lower surface of the flange 300 can serve as auxiliary means for withdrawing the hollow needles 150, the auxiliary member 390 becomes unnecessary. In the alternative, the auxiliary member 390 may be formed as a rigid member integrally fixed to the flange 300.

The lock member attachment device according to this embodiment is constructed in the manner as mentioned above. Use and operation will now be described. First, the assembly A is supplied to the carrier path 101 through the inlet portion 101*a*. The assembly A is flexible as a whole due to runner-less. For this reason, the assembly A is deformed along the carrier path 101 and fallen or dropped by its dead weight. However, in order to more surely bring the inserting front end of the assembly A to the hollow needles 150, the pushing and feeding piece 170 is employed.

When the lever portion 600 in a standby position as indicated by an imaginary line of FIG. 19 is grasped in hand, the vertical wall portion 270*b* pushes the rear surface of the force point piece 260 of the lever member 240. Owing to camming action by the deformed through-hole 280 and the pin 290 and restraining the front surface of the force point piece 260 by the vertical wall portion 270*a*, the front end of the lever member 240 is raised upward. In accordance with this upward rising movement of the lever member 240, the rear end of the link member 310 is raised upward with a time lag as previously mentioned and the front end of the link member 310 is lowered. By this lowering movement of the link member 310, the piston member 120 pushes the coming-off preventive bars B for the assembly A guided in the hollow needles 150 and cut off the unit lock member from the assembly A. The unit lock member thus cut off is then pushed further into the hollow needles 150. Because of time lag, at first, the hollow needles 150 are pierced through the object W and the label L and then, the piston member 120 is operated.

At the same time, the movable plate 400 integral with the lever member 600 is turned about the pin 500 so that the hollow needles 150 are pierced through the object held in the gap 370, the coming-off preventive bars B are pushed and fed to the back surface of the object and the label L, etc. are fixed by the filament portion and the coming-off preventive rods B of the lock member. At that time, a bent and extended portion 600*a* extending from the lever portion 600 pushes up a vertical wall-like bent support portion 340*a* formed on the receiving member 340, raises the receiving portion 360 upward by resiliency and conducts a fastening operation at the basal end of the receiving portion 360. By doing so, the receiving portion 360 is stabilized.

Then, the lever portion 600 is released to return the mechanism to the original condition. At that time, although frictional resistance occurs at the time of withdrawing the hollow needles 150 pierced through the object, the hollow needles 150 can smoothly be returned by the auxiliary member 390 which is abutted with the upper surface of the object presses the same. Furthermore, as previously mentioned, the projected end of the link member 310 slides the bent plate spring 220 upward to pivotally move the feed mechanism 210 so that the assembly A is fed into the hollow needles 150 by one pitch portion at a time. In the illustration, W denotes an object and L denotes a label.

A lock member attachment device and a lock member used therefor according to the present invention are constructed in the manner as hereinbefore described. Accordingly, the lock members,which are not made of metal, formed into a continuous assembly without a need of a provision of any supporting frame can be used with respect to any object. The attachment device is of a handy type and compact, which is simple in mechanism and easy to use. By using the attachment device in combination with auxiliary attachments, it can be used in a wide range of technical field.

What is claimed is:

1. A lock member attachment device comprising a base plate having a flange at a lower edge thereof, a movable plate pivotally supported on said base plate and integrally provided with a lever portion, a part of said movable plate being tensile biased by biasing means disposed between said base plate and said movable plate, a receiving member supported on a front lower part of said base plate such that a part thereof is faced with said base plate, a lever member operatively connected to said movable plate and pivotally supported at a lower end thereof, a link member whose rear end is pin-connected to a front end of said link member through an elongated hole, a piston member being moved up and down by a front end of said link member, a pair of hollow needles for allowing said piston member to be inserted therein, and a lock member feed mechanism pivotally supported and operated by the front end of said link member.

2. A lock member attachment device according to claim 1, wherein a lock member carrier path formed in said base plate and extending to said hollow needles is formed with a guide flange on which a lock member pushing and feeding piece is disposed.

3. lock member attachment device according to claim 1, wherein a space for allowing the object to be pushed therein is formed the lower edge of said base plate and an upper surface of said receiving member, and a stopper member to be abutted with a front end of the inserted object is positionally displaceably disposed in a part of said space.

4. A lock member attachment device according to claim 1, wherein said base plate is provided at a lower end thereof with an auxiliary member for withdrawing said pair of hollow needles from said object, said auxiliary member being provided with a window opening for allowing said needles to be inserted therein.

5. A lock member attachment device according to claim 1, wherein a curved surface portion formed on the front end of said lever portion is engaged with a protruded/bent piece formed on said receiving member, and said receiving member is raised by said lever portion so that said object is sandwiched and pressurized between said receiving member and the lower edge of said base plate.

6. A lock member attachment device according to claim 1, further comprising a claw member disposed at a terminal end of said lock member carrier path near said hollow needles, said claw member being biased by a spring member for preventing said lock member from returning.

7. A lock member attachment device according to claim 1, wherein said lock member feed mechanism pivotally moves a pivotally supported exterior body having a lateral U-shaped configuration in section by slidingly pressing a curved plate spring fitted to said exterior body with a tip portion of said link member when said link member is returned, so that a feed claw formed on a lower end of said exterior body feeds said lock member by a predetermined pitch.

* * * * *